US007406788B2

(12) United States Patent
Uccello, III et al.

(10) Patent No.: US 7,406,788 B2
(45) Date of Patent: Aug. 5, 2008

(54) BEADLESS SIGNAGE SYSTEM AND METHOD

(75) Inventors: Antonio F. Uccello, III, Bradenton, FL (US); Andrei A. Troubeev, Sarasota, FL (US)

(73) Assignee: International Consolidated Companies, Inc., Sarasota, FL (US)

( * ) Notice: Subject to any disclaimer, the term of this patent is extended or adjusted under 35 U.S.C. 154(b) by 0 days.

(21) Appl. No.: 11/573,706

(22) PCT Filed: Jul. 14, 2005

(86) PCT No.: PCT/US2005/024964

§ 371 (c)(1),
(2), (4) Date: Nov. 30, 2007

(87) PCT Pub. No.: WO2006/019895

PCT Pub. Date: Feb. 23, 2006

(65) Prior Publication Data

US 2008/0086923 A1 Apr. 17, 2008

Related U.S. Application Data

(60) Provisional application No. 60/588,695, filed on Jul. 15, 2004.

(51) Int. Cl.
*G09F 17/00* (2006.01)

(52) U.S. Cl. ..... 40/603; 40/604; 40/590; 160/328; 160/378

(58) Field of Classification Search ..... 40/590, 40/603, 604; 160/328, 378; 38/102.1
See application file for complete search history.

(56) References Cited

U.S. PATENT DOCUMENTS

| | | | |
|---|---|---|---|
| 5,398,388 | A | 3/1995 | Coleman |
| 6,250,002 | B1 | 6/2001 | Wittenberg |
| 6,282,822 | B1 | 9/2001 | Rinzler et al. |
| 6,530,165 | B2 | 3/2003 | Griesemer et al. |
| 6,862,825 | B1 | 3/2005 | Lowdnes |
| 7,178,281 | B2 | 2/2007 | Johansson et al. |
| 2002/0029504 | A1 | 3/2002 | Lowdnes |
| 2003/0172568 | A1 | 9/2003 | Uccello et al. |

*Primary Examiner*—Gary C Hoge
(74) *Attorney, Agent, or Firm*—Fish & Richardson P.C.

(57) ABSTRACT

Sign mounting and tensioning apparatus, method and system for beadles signs comprises fired and floating rails adapted to removal y receive and hold elongated locks having sign edges wrapped around non-rotating inserts, and tensioning means for tensioning signs locked in the rails, which tensioning means may be a series of short levering mechanisms spaced along and connectable to the floating rails.

7 Claims, 7 Drawing Sheets

BEADLESS SIGNAGE SYSTEM AND METHOD

CROSS REFERENCE TO RELATED APPLICATIONS

This application is a national phase filing under 35 U.S.C. § 371 of international application No. PCT/US2005/024964, filed Jul. 14, 2005, which claims the benefit of priority of U.S. provisional application No. 60/588,695 filed Jul. 15, 2004. The disclosures of the prior applications are considered part of (and are incorporated by reference in) the disclosure of this application.

TECHNICAL FIELD

This invention relates to signage, and more particularly to mounting and tensioning planar signs on surfaces such as the sides of trucks.

BACKGROUND

There is disclosed in published international patent application WO 03/060333A2, titled Sign and Awning Attachment System and Method of Use, an attachment and tensioning system for a planar structure, such as a vinyl sign or other flexible sheet, such as canvas. The edges of the sheet, which is generally rectangular, are provided with a sewn-in bead which cooperates with other members of an attachment and tensioning system that includes a fixed frame comprised of horizontal and vertical rails. The top horizontal bead and one vertical bead are inserted into fixed rails. The bottom horizontal bead and the remaining vertical bead are inserted into translatable or "floating" rails that in turn connect to adjacent fixed rails by levering means. All rails can be aluminum extrusions. The fixed rails can be attached to a vertical side or door of a truck intended to carry a sign. The system permits signs to be installed and removed without damage, so that a sign can be reused at a future date.

Large signs suitable for truck advertising may typically be in the order of eight feet (2.7 m) high and anywhere from 10 feet to 50 feet (3 to 18 m) wide, printed on vinyl sheets using large, one-pass or multiple-pass ink-jet printers such as the Ultra View 3360 printer (VUTek, Inc., Merideth, N.H., U.S.A.) Beading or "Keeder" is sewn into the edges to prepare the sign for mounting. This is a labor-intensive operation requiring care. The spacing of the opposing beading or "keeder" needs to be set for each signage sheet to within about one-half inch (1.2 cm) tolerance. Because large flexible sheets have a tendency to stretch by a variable amount during printing, sheets are individually beaded to stay within tolerance, which adds considerable cost. Also, beading mistakes are difficult, or in some cases not possible, to rectify.

An aspect of this invention is a beadless attachment and tensioning system employing the type of tensioning means disclosed in published patent application WO 03/06033A2.

Another aspect of this invention is a sign mounting and tensioning apparatus that includes for at least the top sign edge and one vertical sign edge, and preferably also for the bottom edge and remaining vertical edge, elongated flexible but cross sectionally shape-retaining inserts and cooperating elongated locks, whereby sign edges can be wrapped around the inserts, and the wrapped inserts can be removably inserted into the locks such that the inserts do not rotate and the sign edges are secured from slipping out of the locks when the sign is tensioned; fixed frame rails securable to a mounting surface into which the locks containing wrapped top sign edge and one vertical sign edge can be inserted such that the locks do not rotate; and tensioning means for connecting the bottom sign edge and remaining vertical sign edge to fixed mounting means, securable to the mounting surface, such that the sign can be tensioned and secured over the mounting surface, such as a side of a truck or trailer.

Another aspect of this invention is the inclusion in the foregoing apparatus of floating rails for the bottom and remaining vertical side of the sign into which locks containing wrapped sign edges, as described above, can be inserted such that the locks do not rotate, and a plurality of mounting-tensioning units each comprising a mounting portion securable to the mounting surface and a levering tensioning mechanism connectable thereto and to a floating rail.

Yet another aspect of this invention is a method for removably mounting a flexible signage sheet utilizing the above-described apparatus comprising the steps of wrapping the sign edges around inserts, reversibly locking the wrapped inserts into the elongated locks, removably inserting locks containing the wrapped sign edges into the top and vertical rails affixed to a surface and into the bottom and vertical floating rails, removably connecting the floating rails to mounting means affixed to the surface by tensioning means, preferably levering tensioning units, and reversibly tensioning the sign by means of the tensioning means.

Yet another aspect of this invention is a system comprising a flexible sheet sign mounted and tensioned in the apparatus described above.

SUMMARY

This invention includes mounting and stretching apparatus for large rectangularly shaped signs that does not require beaded edges on the sign to attach it to frame members. Rather, apparatus according to this invention can accommodate signs having plain edges. Apparatus according to this invention includes fixed frame members that can be fixedly attached to a surface such as a side of a vehicle, as by riveting, bolting, welding or other suitably secure means. As used in this application, "sign" means a flexible sheet, for example a vinyl sheet or a canvas sheet, bearing writing, printing, graphics, pictures, images or other visual communication; "vehicle" is used in its broadest sense and includes, for example, automobiles, trucks, trailers, trains, airplanes and boats; and "surface" includes any structure on which a rectangular frame can be mounted such as, for example, a building wall, a window frame or a side of a vehicle.

At least two frame members, the top and one vertical side of a rectangular frame, are preferably continuous to facilitate lockingly mounting a plain edge sign. They are formed of continuous metal extrusions, preferably aluminum. They may be one-piece or they may be of multiple sections to achieve the length needed. Plain edges of signs are removably locked in these frame members, or "rails", as will be described. For mounting on a lateral side or top of a vehicle, such as a truck or trailer, it is preferable that the forward vertical sign edge be locked in a continuous rail to prevent wind from having access to the underside of the sign.

A sign fixedly mounted in the foregoing perpendicular rails is then tensioned and releasably secured over the generally planar surface to which the sign is to be applied. This can be achieved by any suitable means. A preferred embodiment utilizes "floating rails," that is, rails similar to the first two rails except not fixedly attached to the surface on which a sign is being mounted. While preferable, it is not required that the floating rails be continuous. To tension a sign locked in perpendicular fixed rails and opposite floating rails and secure it to the surface, each floating rail is pulled outwardly and releasably attached to mounting means affixed to the surface. Such mounting means may be an outer fixed rail, which may be continuous in one or more sections but preferably is discontinuous to save material. Edges of the sign itself or preferably floating rails may be reversibly pulled toward the mounting means and releasably secured thereto with rope or self-locking plastic ties. A preferred embodiment includes lockable levering means to tensioningly connect each floating rail to an outer fixed rail. Most preferably the levering means are discontinuous, but they could be continuous as disclosed in published patent application WO 03/06033A2.

Other, less preferred embodiments include simple studs, D-rings or hooks in place of the outer fixed rail or rail portions for employment of tie-downs, which might or might not be elastic. Tie downs such as self-locking plastic ties, commonly referred to as "zip ties", could be passed through holes drilled in a floating rail (preferably including plastic grommets to protect the ties) or hook onto a floating rail or loop over a protrusion on a floating rail to permit the floating rail to be cinched down. It is even possible to dispense with the floating rails by adding grommets to a sign edge or edges to accommodate tie downs.

Locking unbeaded sign edges into fixed rails and floating rails includes a locking insert around which a sign edge can be wrapped before insertion. The rail is provided with a recess running along its length. Preferably the recess is provided with a plastic liner to protect the sign. More preferably this liner serves as a lock to prevent the sign edge from pulling away from the rail by pressure and friction. The recess is shaped to receive an insert in a non-rotating fashion to lock in place a sign edge wrapped around the insert, thereby permitting tension to be applied to the sign.

Preferred embodiments include a plastic lock that snaps over the insert and engages a wrapped sign edge to prevent it from slipping, and that slides easily into the recess or snaps into the recess in a non-rotating fashion.

This invention includes a method for mounting and tensioning an unbeaded, plain-edged planar sign, generally a rectangular sign, comprising fixedly securing to the surface to be covered perpendicular substantially continuous fixed rails for the top and one vertical side, and fixed rails, preferably discontinuous, or post or other means below and outside the remaining sign edges to which tensioning means may be anchored; clamping the sign into elongated, non-rotating locking mechanisms that prevents the sign edge from slipping out when tension is applied; inserting the locking mechanisms, including clamped sign edges, into substantially sign-wide, preferably continuous, mounting recesses in the top rail and vertical rail, and tensioningly securing the bottom and remaining vertical edge of the sign to the anchoring means.

Preferred embodiments of methods according to this invention include tensioning the sign by securing the bottom and remaining vertical sign edges to substantially sign-wide, preferably continuous, floating rails in the manner described above for the top rail, and camming the floating rails downwardly and outwardly toward fixed anchoring rails to tension the sign in both the horizontal and vertical directions, wherein the anchoring rails are preferably discontinuous sections spaced along the surface to be covered, and reversibly locking the tensioning mechanism.

This invention also includes signage including a flexible printed sheet, preferably vinyl, mounted and tensioned in framing apparatus as described above.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
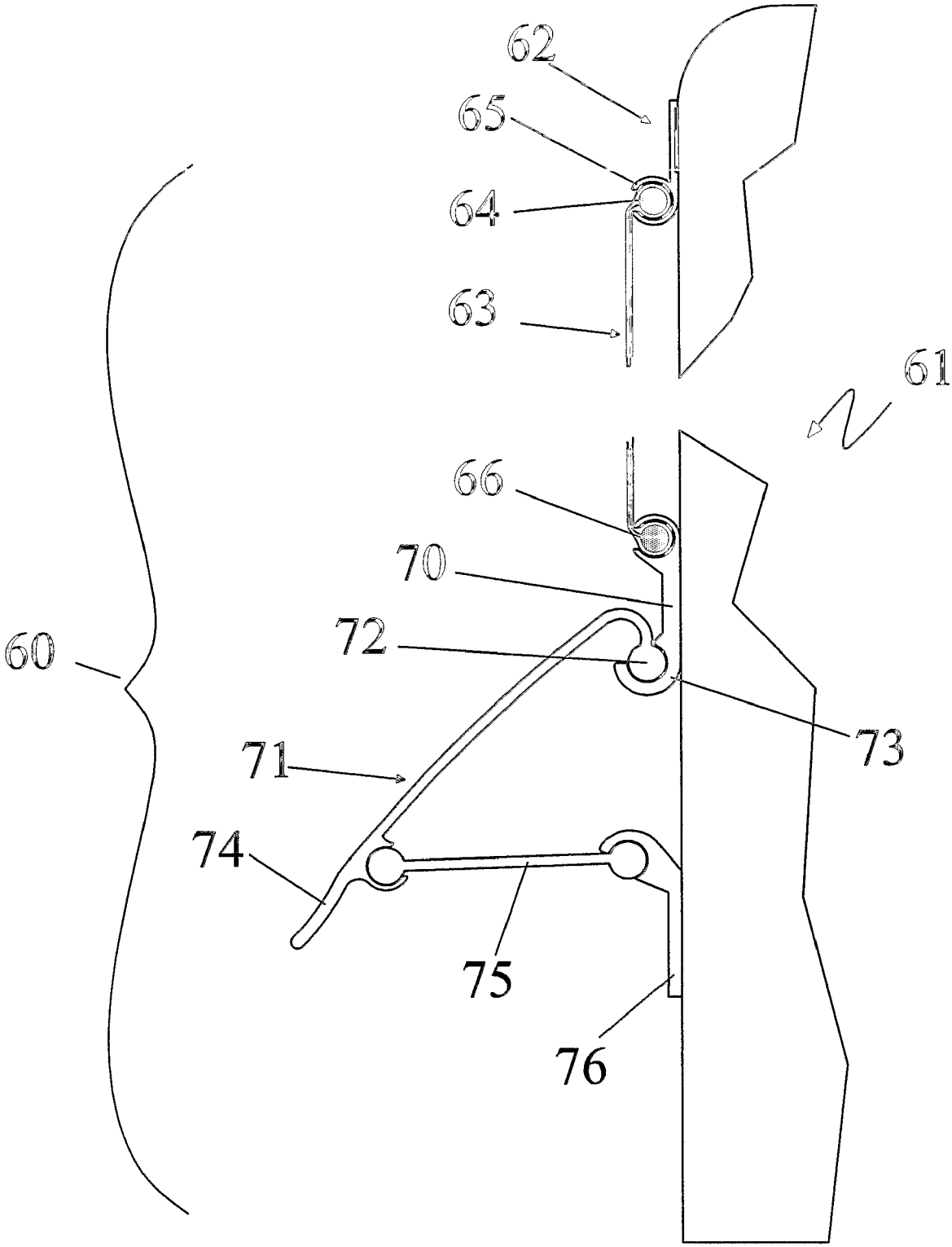
FIG. 1 is an end view of a beaded planar sheet mounted in the attachment and tensioning system of WO 03/060333A2.

FIG. 1 depicts the attachment and tensioning mechanism disclosed in published patent application WO 03/060333A2. FIG. 1 presents basic features of a planar structure attachment and tensioning arrangement, such as an example sign display system for use with a vehicle, in a relaxed, non-tensioned position. As shown in FIG. 1, components of the attachment and tensioning mechanism 60 are attached to the surface of an object 61, such as a truck side or other attachment surface. The system comprises edge beading 64, 66 for the sign or other planar structure and a combination of aluminum extrusions. A fixed rail 62 for securing one side of the planar structure 63 (e.g., a sign or other advertising medium) is firmly attached to the surface of the object 61. To attach one edge of the planar structure 63 (e.g., upper edge, as shown in FIG. 1), for example, the planar structure 63 includes a beaded top edge 64, which is insertable into a slotted feature 65 of fixed rail 62.

Opposite beaded top edge 64 is beaded bottom edge 66, which is introduceable into an open section of floating rail 70, which is not attached to the surface of the object 61, but is free floating and spans the length of the side (here the bottom) of the image. Tension can be applied to planar structure 63 normal to beads 64, 66 by a frame-wide tensioning lever arm 71. One side 72 of tensioning arm 71 is coupled to the moveable rail 70 via a coupling 73 that receives one side of the tensioning lever arm 71. The other side 74 of tensioning lever arm 71 is coupled to one end of a frame-wide beam 75, which in turn is coupled via, for example, an open trough, to lower frame-wide fixed rail 76 that is firmly attached to the surface of the object 61.

The image is tensioned when the cam lever or tensioning arm 71 is closed, thereby pulling floating rail 70 away from top rail 62. Tensioning lever arm 71 pivotally rotates within the coupling 73 of floating rail 70. Pivotal rotation of tensioning lever arm 71 causes pivotal rotation of the beam 75 about both the coupling 77 of the tensioning lever arm 71 and the coupling of lower fixed rail 76. Once the lower side 74 of tensioning lever arm 71 passes over the center of the beam 75, tensioning lever arm 71 becomes locked in a tensioned position and the planar surface 63 is in "the drum taught position." To secure the frame-wide levering arm in its locked, tensioning position, end caps are applied and secured to the truck or other surface.

Figure 2:
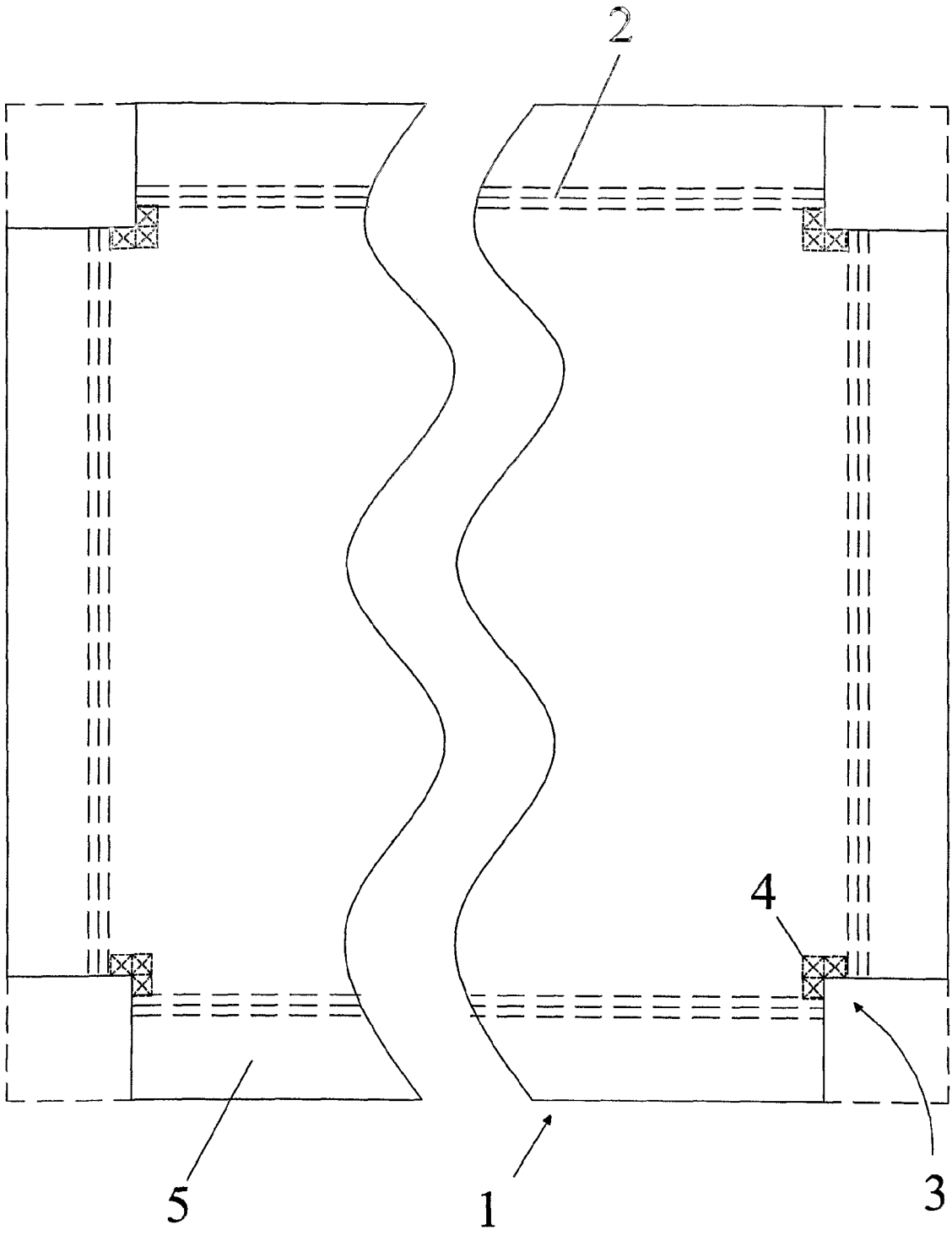
FIG. 2 shows an embodiment of planar sheet prepared for mounting in the attachment and tensioning system of this invention.

FIG. 2 shows sign 1, a flexible, rectangular, planar sheet readied for beadless mounting according to this invention. Sign 1 has four corners 3 removed so as to create foldable edges 5 that are foldable along registration marks 2. Optionally corner areas may be reinforced by sewing or other reinforcing means indicated at 4. Sign 1 is marked with peripheral registration marks 2 for alignment during mounting. In the embodiment depicted, two additional sets of registration marks (unnumbered) are added, one set inside marks 2 and one set outside marks 2, for possible adjustment.

Figure 3:
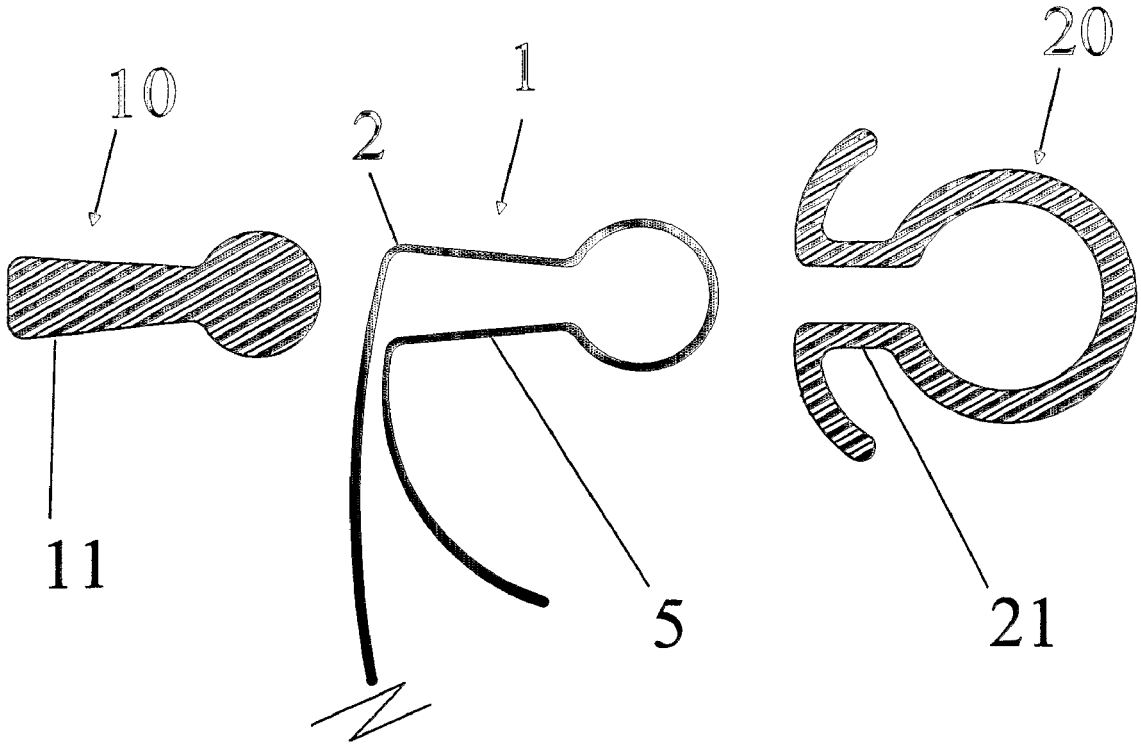
FIG. 3 is an exploded end view of a locking arrangement according to this invention.

FIG. 3 shows an exploded end view of a locking mechanism according to this invention. An edge 5 of sign 1 (FIG. 2) is wrapped around non-rotating insert 10 that contains portion 11 of non-circular cross section. Registration marks 2 are utilized to fix the location of sheet 1 relative to insert 10. Insert 10 and wrapped edge 5 are inserted into lock 20 which contains portions 21 of non-circular cross section that pressingly clamp portion 11 of insert 10. Insert 10 is flexible lengthwise but shape-retaining in cross section. It might be a durable plastic extrusion, but it could also be an aluminum extrusion. It has rounded corners so as not to damage sheet 1. Insert 10 may be multiple pieces placed end-to-end, for example, two eight-ft (2.7 m) lengths and one four-ft (1.35 m) length for a sign twenty feet (6.8 m) wide. Lock 20 is preferably a plastic extrusion, for example, nylon. It is resiliently flexible in order that it can be snapped over insert 10 and folded edge 5 and later gently pried off without ruining the sign, the insert, or the lock itself and reused when sign 1 is changed. Friction between the interior surface of lock 20 and sign 1 prevents edge 5 from slipping during use. Clamping portions 21 of lock 20 include flared ends with rounded corners so as to protect sheet 1 (see FIG. 4). As with insert 10, lock 20 may be multiple pieces placed end-to-end. We prefer that joints between lengths of lock 20 are offset from joints between lengths of insert 10 so that the assembled construction can be handled as a single unit. Insert 10 and the cooperating inner surface of lock 20 are of non-circular cross section such that insert 10 is prevented from rotating within the lock when tension is applied to sheet 1, thus preventing locked edge 5 from unwinding. Numerous cross-sectional profiles for insert 10 will fulfill these requirements, as will be appreciated. All four edges 5 of sheet 1 are so locked.

Figure 4:
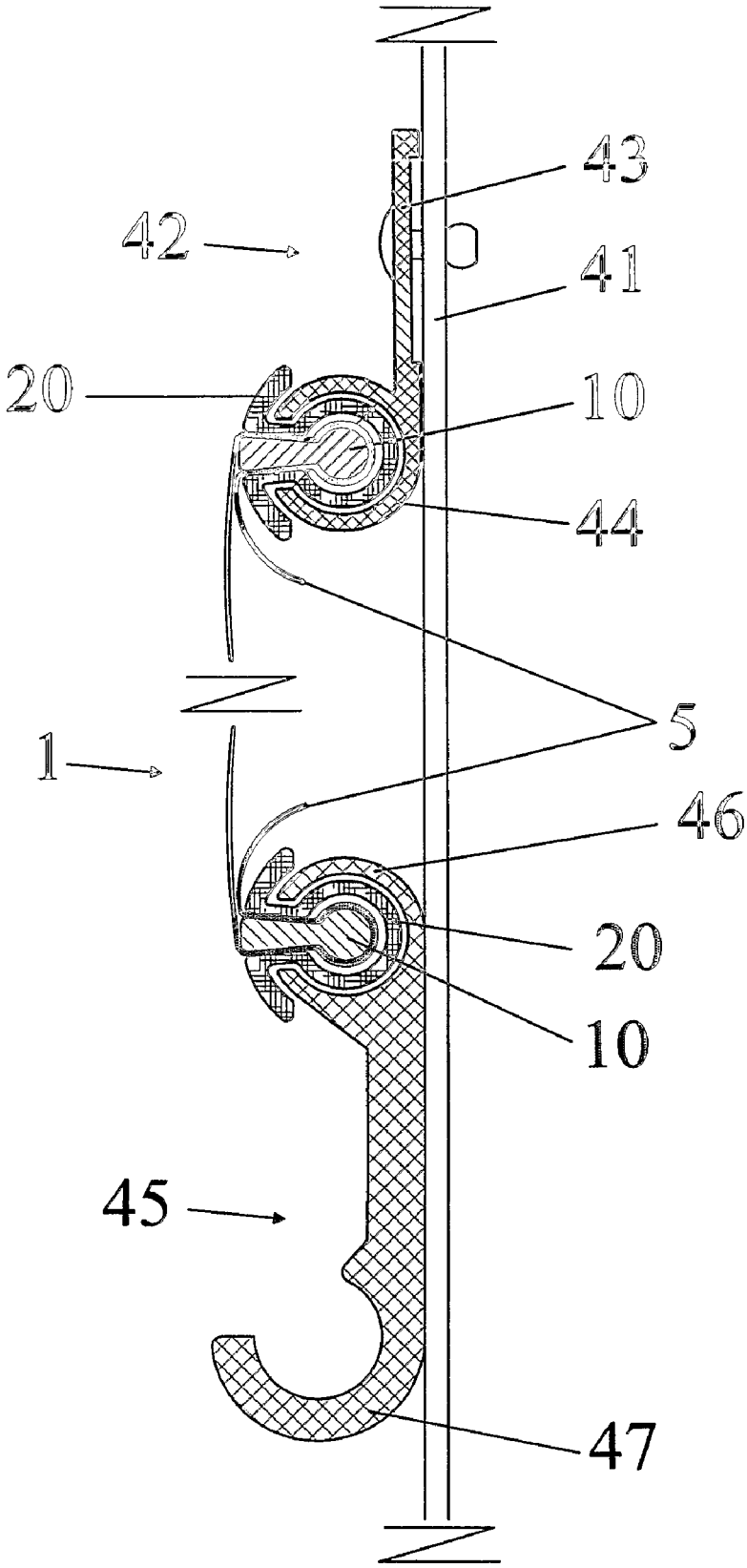
FIG. 4 is an end view of a planar sheet locked in the top rail and opposite floating rail of an embodiment of this invention.

FIG. 4 shows an end view of the components that hold the top and bottom edges 5 of sign 1. Top edge 5 is shown wrapped around an insert 10 and inserted into a lock 20, as described in connection with FIG. 3. Bottom edge 5 is similarly locked. Fixedly mounted, by bolting or riveting, on surface 41, which may be a truck or trailer side, is top rail 42, that includes a coupler or shaped recess 44 for receiving locked top edge 5, outwardly (in this case upwardly) extending mounting side 43. Floating, that is, not fixedly attached to surface 41, is floating rail 45, that includes a coupler or shaped recess 46 for receiving locked bottom edge 5 and outwardly (in this case downwardly) projecting portion comprising coupler 47. The system is the same for vertical edges 5 of sheet 1 (see FIG. 6). One vertical fixed rail 81 is identical (except perhaps for length) to fixed top rail 42, and the opposite side has a vertically oriented floating rail 83 identical (except perhaps for length) to floating rail 45. Each lock 20, carrying an insert 10 and a locked edge 5, is slidingly inserted into respective coupler 44 or 46 by feeding from an end. Lock 20 and insert 10 are shaped relative to couplers 44, 46 such that they do not rotate when in place, and lock 20 protects its locked edge 5 from contacting the coupler edges. By flaring both ends of locks 20 as depicted, which we call an "omega" construction, a single construction can be used for all four sign edges.

Figure 5:
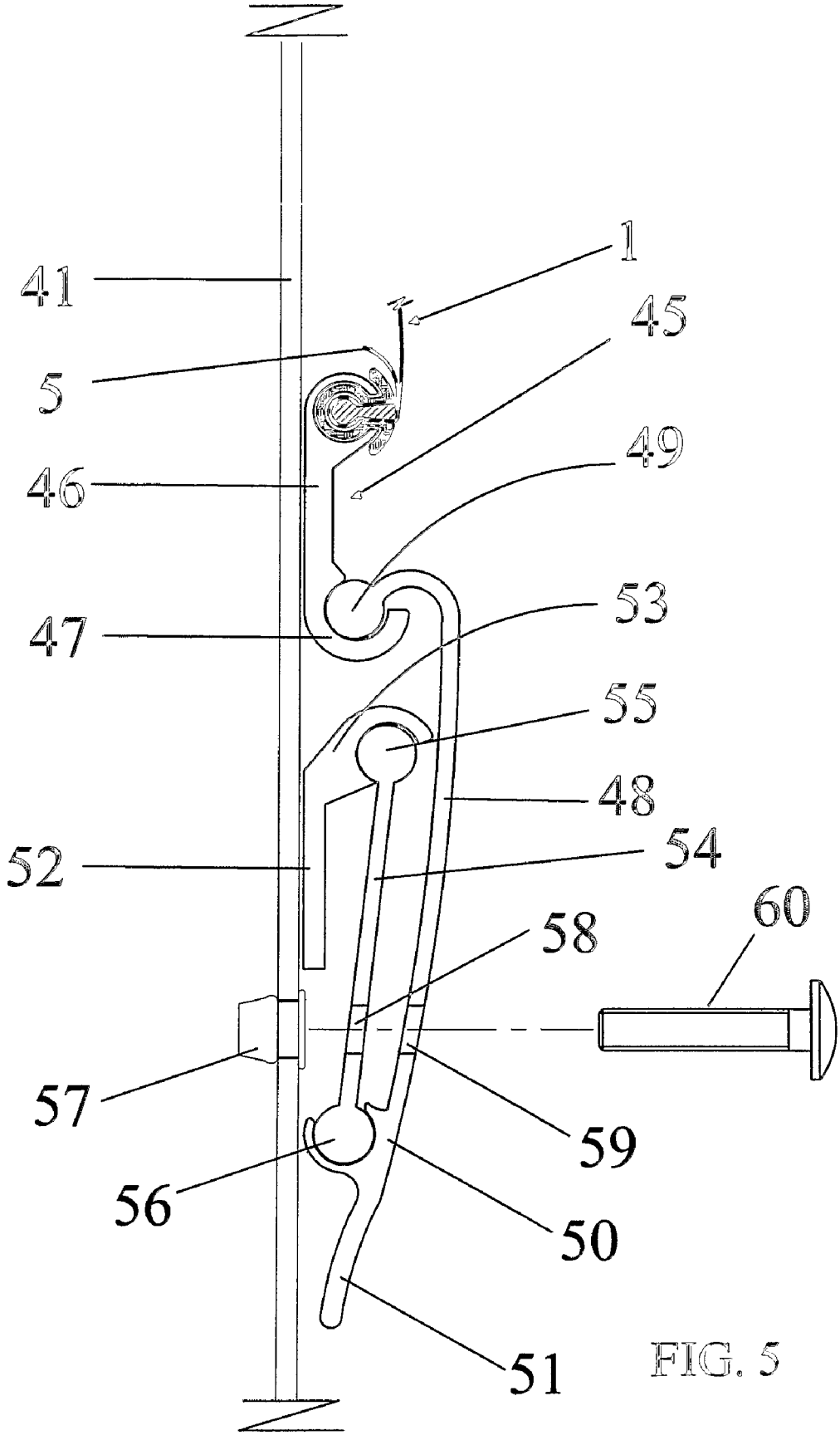
FIG. 5 is an end view of a planar sheet locked in the top rail and opposite floating rail of an embodiment of this invention showing the bottom floating rail and bottom fixed rail or rail section locked together by levering members.

FIG. 5 shows the lower tensioning portion of the embodiment depicted in FIG. 4. Outside (here below) floating rail 45 is a fixed mounting means and lockable tensioning means, which in this embodiment and not continuous across the width of the sign (see FIG. 6). Although the mounting means and the tensioning means may be preassembled as a unit affixable to surface 41, they need not be preassembled. A preferred mounting means is bottom fixed rail section 52 that includes coupler 53, which may be a section of the same aluminum extrusion as top rail 42 (FIG. 4). The mechanism for tensioning sheet 1 includes tensioning lever arm 48 and beam 54. Arm 48 includes cylindrical end 49 pivotally engaged in coupler 47 of floating rail 45. Beam 54 contains cylindrical ends 55, 56 pivotally engaged in coupler 50 of arm 48 and coupler 53 of fixed rail 52. As indicated, elements 52, 54 and 58 may be a preassembled unit, and stops (not shown) may be included to prevent cylindrical ends 55, 56 from sliding out of their couplers 53, 50, thereby forming permanent hinge joints. When lever arm 48 is pivoted downwardly, that is, away from sign 1, by 15 pushing on its end 51, floating rail 45 is pulled downwardly, tensioning sheet 1, until arm 48 reaches its locked tensioning position shown in the figure. Lever arm 48 and beam 54 have circular holes 58, 59 that align with rivnut 57 when in the locked tensioning position. Flanged button head cap 60 is removably inserted into rivnut 57 through holes 58, 59 to prevent the system from becoming inadvertently unlocked. The tensioning vertical side is identically constructed (see FIG. 6). Vertical floating rail 83 is tensioningly secured in the identical manner utilizing horizontally placed tensioning arms 48 and their related beams 54 and outer fixed rail sections 52 (not visible in FIG. 6).

Figure 6:
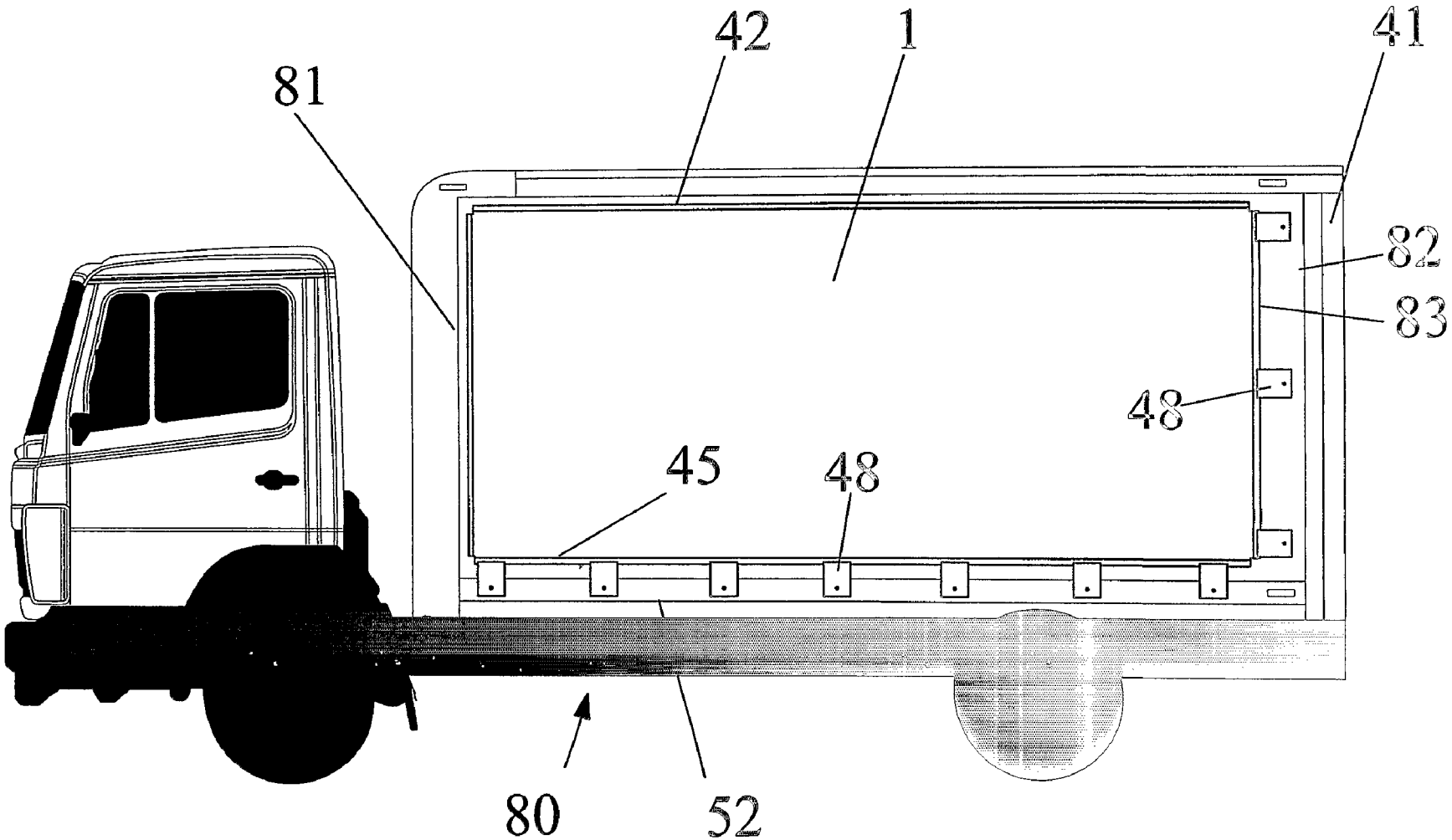
FIG. 6 is a simplified elevation of a truck including a mounted and tensioned sign according to the embodiment shown in FIGS. 3-5.

FIG. 6 shows the embodiment described above installed on side panel 41 of a truck 80 with a tensioned sign 1. Top fixed rail 42 is continuous but in sections. Floating rail 45 is also continuous but in sections. A series of preassembled mounting and tensioning units (FIG. 5) are affixed to side 41 and tensioningly connected to bottom floating rail 45. Lever arms 48 are visible in this view. Horizontal tensioning is the same. It includes fixed rail 81, floating rail 83, and a plurality of mounting and tensioning units including lever arms 48. Tension arm 48 could be continuous in each case, but it is shown here as a series of discrete units about six inches (15 cm) wide spaced along floating rails 45, 83. We prefer spacing of very approximately three feet (1 m) with floating rail joints covered.

Figure 7:
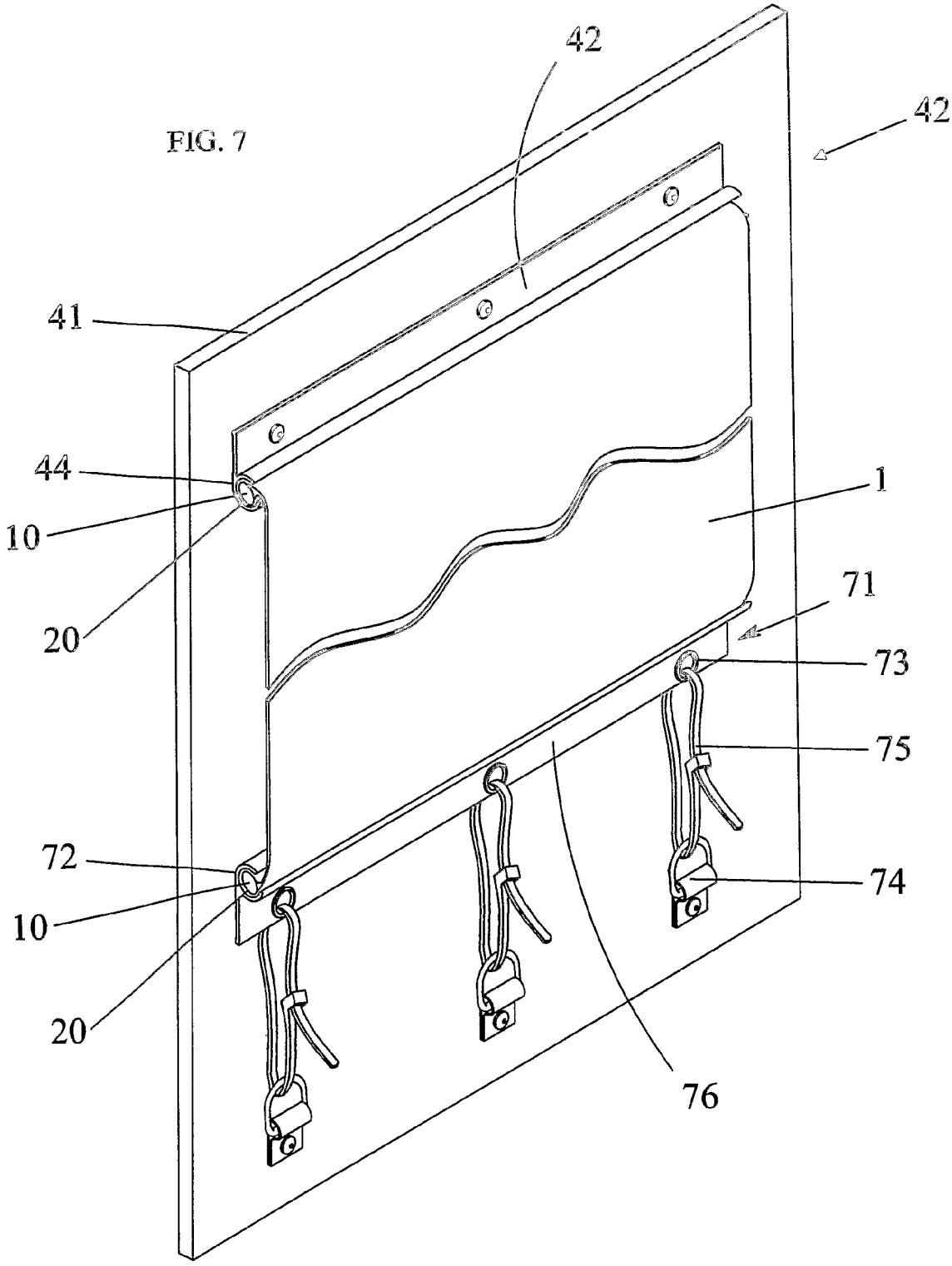
FIG. 7 is a perspective view of a mounted and tensioned sign according to another embodiment of this invention.

FIG. 7 shows a portion of a second embodiment of a tensioned sign system according to this invention that includes tensioning components different from those utilized in the embodiment depicted in FIGS. 2-6. FIG. 7 shows a section of surface 41 and a central vertical portion planar sheet 1. In this embodiment upper rail 42 is the same as the previous embodiment described in connection with FIG. 4. Also, insert 10 and lock 20 are the same as described in connection with FIG. 39 as are their assembly with top and bottom sign edges 5 and sliding installation into the rails. In this embodiment floating rail 71 is very much like top rail 42 but placed "upside down." It includes coupler 72 that is identical to coupler 44 and flat mounting side 76, which is identical to side 43 except that it includes large grommeted holes 73 for receiving tie-down straps. Located outside (here beneath) floating rail 71 is a series D-rings 74 fastened to surface 41 beneath grommeted holes 73. Self-locking plastic ties 75, commonly called zip ties, are passed through holes 73 and D-rings 74 and pulled tight in order to tension planar sheet 1 in the vertical direction. Rotating the image of FIG. 7 by 90 degrees shows the same mechanical elements and method for horizontal mounting and tensioning planar sheet 1. In this embodiment ties 75 are simply cut and replaced when removing a first sign 1 and constructing a tensioned sign system with another sign 1.

A number of embodiments of the invention have been described. Nevertheless, it will be understood that various modifications may be made without departing from the spirit and scope of the invention. For example, different cross-sectional shapes for an insert 10, lock 20 and cooperating rail recess 44 could be utilized. Accordingly, other embodiments are within the scope of the following claims.

What is claimed is:

1. Apparatus for mounting on a surface and tensioning rectangular signs having a top edge, a bottom edge, a first vertical edge and a second vertical edge, comprising a top rail and first vertical rail fixedly mountable on said surface and including an elongated recess adapted to removably receive and hold an elongated lock and to prevent the same from rotating, a floating bottom rail and floating second vertical rail also including an elongated recess adapted to removably receive and hold said lock to prevent the same from rotating, elongated flexible but cross sectionally shape retaining inserts about which edges of the sign can be wrapped, wherein said elongated locks are flexibly resilient and adapted to removably receive said inserts with sign edges wrapped thereabout such that the sign edges are firmly secured and the inserts are not rotatable within the locks, mounting means fixedly mountable on said surface outside the bottom edge and second vertical edge of said sign, and tensioning means for releasably securing said floating rails to said mounting means and tensioning the sign vertically and horizontally.

2. The apparatus according to claim 1 wherein said mounting means and said tensioning means together comprise multiple units that can be spaced from one another beneath said top rail and spaced from one another opposite said first vertical rail, and wherein said tensioning means of each unit comprises a levering arm and beam unit hingedly connected to said mounting means and releasably connectable to said floating rails.

3. The apparatus according to claim 1 wherein said mounting means comprises loops, wherein said floating rails include a series of holes, and wherein said tensioning means comprise a plurality of self-locking plastic ties.

4. The apparatus according to claim 1 wherein said elongated inserts and locks comprise sections placed end-to-end.

5. A tensioned sign applied to a side of a vehicle comprising apparatus according to claim 1 applied to said side and a sign mounted in said locks under tension.

6. A method of removably mounting and tensioning a sign utilizing the apparatus of claim 1 affixed to a surface, comprising wrapping the edges of the sign around said elongated inserts, reversibly locking the wrapped inserts in said elongated locks, removably inserting the locks containing wrapped sign edges into the recesses of the fixed rails and the floating rails, and releasably tensioningly connecting the floating rails to the mounting means utilizing said tensioning means.

7. The method according to claim 6 further comprising first removing a previous sign tensioningly mounted in said apparatus comprising releasing said tensioning means and disconnecting said floating rails therefrom, removing said elongated locks from said top rail, first vertical rail and floating rails, disconnecting said elongated locks from said elongated inserts and sign edges, and unwrapping and removing said sign edges from said inserts.

* * * * *